US011384920B2

(12) United States Patent
Okuno et al.

(10) Patent No.: US 11,384,920 B2
(45) Date of Patent: Jul. 12, 2022

(54) ILLUMINATION DEVICE

(71) Applicant: Panasonic Intellectual Property Management Co., Ltd., Osaka (JP)

(72) Inventors: Tatsuya Okuno, Osaka (JP); Kazuyuki Yamae, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 17/045,390

(22) PCT Filed: Mar. 18, 2019

(86) PCT No.: PCT/JP2019/011095
§ 371 (c)(1),
(2) Date: Oct. 5, 2020

(87) PCT Pub. No.: WO2019/198430
PCT Pub. Date: Oct. 17, 2019

(65) Prior Publication Data

US 2021/0148547 A1 May 20, 2021

(30) Foreign Application Priority Data

Apr. 12, 2018 (JP) ..... JP2018-076521

(51) Int. Cl.
*F21V 9/40* (2018.01)
*F21V 29/76* (2015.01)
(Continued)

(52) U.S. Cl.
CPC ..... *F21V 9/40* (2018.02); *F21V 3/02* (2013.01); *F21V 9/32* (2018.02); *F21V 29/763* (2015.01)

(58) Field of Classification Search
CPC . F21V 9/40; F21V 9/32; F21V 29/763; F21V 3/02
See application file for complete search history.

(56) References Cited

U.S. PATENT DOCUMENTS 8,096,668 B2 * 1/2012 Abu-Ageel ..... G02B 5/045 362/84
8,575,642 B1 * 11/2013 Shum ..... H01L 33/44 257/98

(Continued)

FOREIGN PATENT DOCUMENTS

JP 2008-524827 A 7/2008
JP 2009-164443 A 7/2009

(Continued)

OTHER PUBLICATIONS

International Search Report for corresponding Application No. PCT/JP2019/011095, dated Jun. 4, 2019.

(Continued)

*Primary Examiner* — Arman B Fallahkhair
(74) *Attorney, Agent, or Firm* — Renner, Otto, Boisselle & Sklar, LLP

(57) ABSTRACT

An illumination device includes a housing including an opening portion, a wavelength converting component which is disposed inside the housing and radiates wavelength-converted light having a different wavelength from that of a laser beam after the laser beam enters the component, an optical film which covers the opening portion and has optical properties such that the transmittance for the wavelength-converted light is 80% or more and the transmittance for the laser beam at the peak wavelength is 80% or less of the transmittance for the wavelength-converted light at the peak wavelength, and a light diffusing structure which is disposed on at least part of the inner wall of the housing and diffusely reflects the laser beam reflected at least by the optical film.

8 Claims, 7 Drawing Sheets

(51) Int. Cl.
*F21V 9/32* (2018.01)
*F21V 3/02* (2006.01)

(56) References Cited

U.S. PATENT DOCUMENTS

| | | | | |
|---|---|---|---|---|
| 9,863,595 | B2 * | 1/2018 | Takahira | F21S 41/337 |
| 10,060,580 | B2 * | 8/2018 | Annen | F21S 41/255 |
| 10,274,138 | B2 * | 4/2019 | Nishi | H01S 5/0087 |
| 10,324,247 | B2 * | 6/2019 | Hikmet | F21V 7/0091 |
| 10,788,190 | B2 * | 9/2020 | Signoretto | F21V 29/87 |
| 2004/0233664 | A1 | 11/2004 | Beeson et al. | |
| 2006/0131602 | A1 | 6/2006 | Ouderkirk | |
| 2006/0203468 | A1 * | 9/2006 | Beeson | H01L 33/60 362/84 |
| 2009/0174929 | A1 | 7/2009 | Egawa | |
| 2010/0259918 | A1 * | 10/2010 | Rains, Jr. | F21K 9/64 362/84 |
| 2011/0149594 | A1 | 6/2011 | Terajima | |
| 2013/0279151 | A1 | 10/2013 | Ouderkirk | |
| 2015/0330591 | A1 | 11/2015 | Adachi | |

FOREIGN PATENT DOCUMENTS

| | | | |
|---|---|---|---|
| JP | 2011-134485 | A | 7/2011 |
| JP | 2014-132515 | A | 7/2014 |
| JP | 2014-135159 | A | 7/2014 |
| JP | 2015-023215 | A | 2/2015 |
| WO | 2006/068766 | A2 | 6/2006 |
| WO | 2009092041 | A2 | 7/2009 |

OTHER PUBLICATIONS

Extended European Search Report for corresponding European Application No. 19786060.4, dated Apr. 30, 2021.

* cited by examiner

ILLUMINATION DEVICE

TECHNICAL FIELD

The present disclosure relates to illumination devices, and particularly relates to illumination devices using laser beams.

BACKGROUND ART

In the related art, illumination devices using laser beams are known, each of which includes a laser beam source which emits a laser beam, and a wavelength converting component such as a phosphor. In such illumination devices, illumination light having a desired light color is obtained by mixing wavelength-converted light, which is generated by irradiating the wavelength converting component with the laser beam and absorbing part of the laser beam in the wavelength converting component, with part of the laser beam not subjected to such wavelength conversion in the wavelength converting component.

For example, in an illumination device including a laser beam source which emits a laser beam of blue light and a phosphor which emits yellow green light, the yellow green light (wavelength-converted light) emitted from the phosphor as a result of absorption of part of blue light emitted from the laser beam source by the phosphor is mixed with the blue light (laser beam) not absorbed by the phosphor, providing white illumination light.

As a traditional illumination device using a laser beam, a reflective illumination device is disclosed, which radiates illumination light obtained by causing a laser beam to enter the surface of a wavelength converting component from an oblique direction, and mixing the color of wavelength-converted light generated by the wavelength converting component with the color of the laser beam reflected by the wavelength converting component (for example, PTL 1).

CITATION LIST

Patent Literature

PTL 1: Japanese Unexamined Patent Application Publication No. 2014-135159

SUMMARY OF THE INVENTION

Technical Problems

The laser beam has higher directivity than those of other types of light from LEDs and the like. Such high directivity causes color unevenness of illumination light in the traditional illumination device using the laser beam. In other words, the laser beam reflected by the wavelength converting component has high directivity while the wavelength-converted light generated through wavelength conversion of the laser beam by the wavelength converting component is diffused light and has no directivity. For this reason, the color of the laser beam and the color of the wavelength-converted light are not desirably mixed, causing color unevenness of the irradiation pattern of the mixed light (illumination light), which is the mixed-color light of the laser beam and the wavelength-converted light.

To solve this problem, by forming projections and depressions on the surface of the wavelength converting component or mixing a filler having light scattering properties in the wavelength converting component, the laser beam may be diffused (scattered) when the laser beam is reflected by the wavelength converting component, thereby relaxing the directivity of the laser beam.

In this method, however, the laser beam which enters the wavelength converting component is back-scattered before absorbed by the wavelength converting component, and is released to the outside of the wavelength converting component. When such a phenomenon becomes remarkable, the absorptivity of the laser beam by the wavelength converting component is inevitably reduced. As a result, for example, when the laser beam is blue light, the blue color component in the mixed light of the laser beam and the wavelength-converted light is hardly reduced, and white light having a low color temperature is hardly obtained as mixed light, reducing the freedom of color design of the mixed light. As above, the method of diffusing the laser beam with the wavelength converting component suffers from a narrow color range of the mixed light of the laser beam and the wavelength-converted light because the diffusibility of the laser beam and the absorptivity of the wavelength converting component are in a trade-off relation.

An alternative may be a method of diffusing mixed light after the color of the laser beam is mixed with the color of the wavelength-converted light, rather than the laser beam is diffused by the wavelength converting component. Examples thereof include a method of diffusing the mixed light of the laser beam and the wavelength-converted light by disposing a diffusion transmission component such as a diffusion transmission panel or a diffusion transmission film in an opening portion of the illumination device.

In this method, however, the laser beam contained in the mixed light is diffused, and at the same time, part of the wavelength-converted light having no directivity whose further diffusion is unnecessary, is back-scattered. This results in a reduction in light extraction efficiency of the illumination device.

The present disclosure has been made to solve such problems, and an object of the present disclosure is to provide an illumination device which produces illumination light having reduced color unevenness without reducing light extraction efficiency and enables color design of the mixed light in a wide color range.

Solutions to Problems

To solve the above object, one aspect of the illumination device according to the present disclosure includes a housing including an opening portion; a wavelength converting component which is disposed inside the housing and radiates wavelength-converted light after a laser beam enters the wavelength converting component, the wavelength-converted light having a different wavelength from a wavelength of the laser beam; an optical film which covers the opening portion, the optical film having optical properties such that a transmittance for the wavelength-converted light is 80% or more and a transmittance for the laser beam at a peak wavelength is 80% or less of a transmittance for the wavelength-converted light at a peak wavelength; and a light diffusing structure which is disposed on at least part of an inner wall of the housing and diffusely reflects the laser beam reflected by at least the optical film.

Advantageous Effects of Invention

According to the present disclosure, color unevenness of the illumination light can be reduced without reducing the light extraction efficiency, and color design of the mixed light in a wide color range is enabled.

DESCRIPTION OF EXEMPLARY EMBODIMENTS

Figure 1:
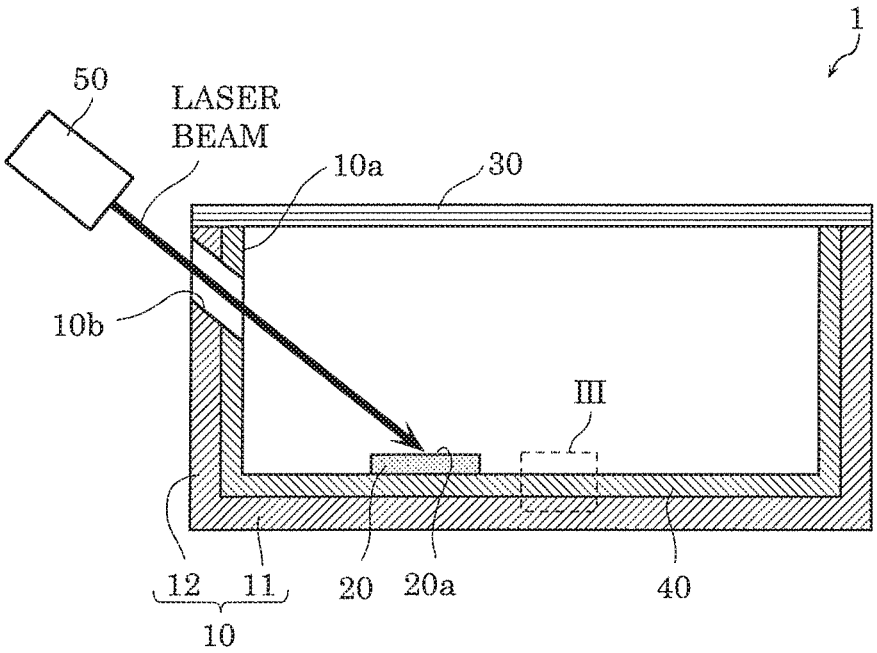
FIG. 1 is a diagram illustrating a configuration of the illumination device according to an embodiment.

The embodiments according to the present disclosure will now be described. The embodiments described below all illustrate specific examples of the present disclosure. Accordingly, numeric values, shapes, materials, components, arrangements and positions of components, and connection forms thereof illustrated in the following embodiments are exemplary, and should not be construed as limitations to the present disclosure. Accordingly, among the components of the following embodiments, the components not described in an independent claim representing the most superordinate concept of the present disclosure are described as arbitrary components.

The drawings are schematic views, and are not always strictly drawn. Accordingly, the scale is not always consistent in the drawings, for example. In the drawings, identical referential numerals are given to substantially identical configurations, and the duplication of the description will be omitted or simplified.

Embodiments

The configuration of illumination device 1 according to an embodiment will be described with reference to FIG. 1. FIG. 1 is a diagram illustrating a configuration of illumination device 1 according to the embodiment. In FIG. 1, the cross-section of illumination device 1 excluding light source 50 is illustrated.

As illustrated in FIG. 1, illumination device 1 includes housing 10 including opening portion 10*a*, wavelength converting component 20 disposed inside housing 10, optical film 30 disposed in opening portion 10*a* of housing 10, and light diffusing structure 40 disposed on at least part of an inner wall of housing 10. Illumination device 1 according to the present embodiment further includes light source 50.

Housing 10 is an accommodator including opening portion 10*a*. In the present embodiment, housing 10 accommodates wavelength converting component 20. Housing 10 has bottom portion 11 and side wall portion 12 erected from bottom portion 11. Bottom 11 faces opening portion 10*a*. As one example, bottom portion 11 has a rectangular shape seen in planar view. In this case, bottom portion 11 is surrounded by four side wall portions 12.

Housing 10 supports wavelength converting component 20 and optical film 30. Specifically, the wavelength converting component is supported by bottom portion 11 of housing 10. Optical film 30 is supported by the opening end portion of opening portion 10*a* of housing 10. Wavelength converting component 20 and optical film 30 are fixed to housing 10 by bonding or using a latch structure or a screw.

Housing 10 is made of a metallic material, a resin material, or a ceramic, for example. To dissipate heat generated in wavelength converting component 20, housing 10 may be made of a material having high thermal conductivity. Accordingly, housing 10 may be made of a metallic material, a resin material high thermal conductivity, or a ceramic.

Wavelength converting component 20 is disposed inside housing 10. Specifically, wavelength converting component 20 is placed on bottom portion 11 of housing 10.

Wavelength converting component 20 radiates wavelength-converted light having a wavelength different from that of a laser beam after the laser beam enters wavelength converting component 20. In other words, wavelength converting component 20 converts the laser beam entering wavelength converting component 20 into light having a wavelength different from that of the laser beam. Specifically, wavelength converting component 20 outputs light having a wavelength different from that of the laser beam through absorption of the laser beam having a specific wavelength.

Wavelength converting component 20 does not completely absorb the laser beam and then convert it to light having a different wavelength. Rather, wavelength converting component 20 absorbs part of the laser beam and outputs light having a different wavelength while reflecting another part of the laser beam without absorption thereof. In other words, part of the laser beam entering wavelength converting component 20 is converted into wavelength-converted light having a wavelength converted by wavelength converting component 20 and is radiated from wavelength converting component 20, while another part of the laser beam entering wavelength converting component 20 is reflected by wavelength converting component 20 and is radiated from wavelength converting component 20 without wavelength conversion by wavelength converting component 20. Specifically, wavelength converting component 20 has incident surface 20*a* which the laser beam enters. After incident surface 20*a* is irradiated with the laser beam, incident surface 20*a* absorbs part of the laser beam and outputs light having a different wavelength while reflecting another part of the laser beam.

As wavelength converting component 20, a fluorescent element containing at least one phosphor can be used, for example. In this case, wavelength converting component 20 (fluorescent element) emits fluorescence where the incident light serves as excitation light. As one example, wavelength converting component 20 can be a fluorescent element including fluorescent particles dispersed in a binder made of a resin material such as a silicone resin or an inorganic material such as glass or a ceramic.

Wavelength converting component 20 (fluorescent element) is excited through irradiation with the laser beam emitted from light source 50 as excitation light, and radiates fluorescence having a desired color (wavelength). In other words, after the laser beam emitted from light source 50 enters wavelength converting component 20, wavelength converting component 20 absorbs part of the laser beam, and is excited. Thereby, fluorescence having a predetermined color (wavelength) is radiated from wavelength converting component 20 as wavelength-converted light. For example, wavelength converting component 20 contains a phosphor which absorbs blue light having a wavelength in the range of 420 nm to 480 nm and radiates yellow green light having a wavelength from 510 nm to 590 nm. In other words, wavelength converting component 20 radiates yellow green light as the wavelength-converted light. Such a phosphor to be used can be cerium (Ce)-doped yttrium-aluminum-garnet (YAG) fluorescent particles. Wavelength converting component 20 may contain several fluorescent bodies having different fluorescence peak wavelengths.

The wavelength-converted light radiated from wavelength converting component 20 is scattered light and has no directivity. For example, the fluorescence emitted from the phosphor is radiated in all the directions. On the other hand, although the directivity of the laser beam reflected by wavelength converting component 20 can be somewhat weakened by the light diffusibility of wavelength converting component 20, the light diffusibility of wavelength converting component 20 and the light absorptivity thereof are in a trade-off relation. In the present embodiment, the light absorptivity of wavelength converting component 20 takes precedence over the light diffusibility and a lower light diffusibility is preferred. Accordingly, wavelength converting component 20 had better not to contain a light scattering material which scatters light, such as a filler or nanoparticles, or to diffuse the laser beam somewhat, wavelength converting component 20 may contain a light scattering material.

Examples of wavelength converting component 20 containing fluorescent particles include those containing fluorescent particles encapsulated in any encapsulating material. In this case, the light diffusibility and light absorptivity of wavelength converting component 20 can be controlled by the shape, the size, and the refractive index of the fluorescent particles.

Although the fluorescent element containing a phosphor has been exemplified as wavelength converting component 20 in the present embodiment, wavelength converting component 20 can be made of any material as long as it converts the wavelength of the incident laser beam to a different wavelength and outputs the resulting light.

Optical film 30 covers opening portion 10*a* of housing 10 including wavelength converting component 20 which the laser beam enters. Thereby, the wavelength-converted light obtained by wavelength conversion of the laser beam which enters wavelength converting component 20 and radiated by wavelength converting component 20 and part of the laser beam which enters wavelength converting component 20 reflected by wavelength converting component 20 without wavelength conversion by wavelength converting component 20 enter optical film 30. Not only these direct light beams but also scattered light beams generated through diffuse reflection of the laser beam and the wavelength-converted light by light diffusing structure 40 enter optical film 30.

Optical film 30 has optical properties to selectively transmit and reflect specific wavelengths of the light beams entering optical film 30.

Specifically, optical film 30 has optical properties such that the transmittance for the wavelength-converted light radiated from wavelength converting component 20 is 80% or more. In other words, optical film 30 has a high transmittance for the wavelength-converted light radiated from wavelength converting component 20, and transmits most of the wavelength-converted light which is radiated from wavelength converting component 20 and enters optical film 30. More preferably, the transmittance of optical film 30 for the wavelength-converted light is 90% or more.

In the present embodiment, optical film 30 has a high transmittance not only for the wavelength-converted light radiated from wavelength converting component 20, but also for light other than the wavelength-converted light outside the wavelength bandwidth of the laser beam emitted from light source 50. For example, the transmittance of optical film 30 outside the wavelength bandwidth of the laser beam entering wavelength converting component 20 is preferably 80% or more. This improves the light extraction efficiency of the illumination light emitted from illumination device 1. More preferably, the transmittance of optical film 30 outside the wavelength bandwidth of the laser beam entering wavelength converting component 20 is 90% or more. In other words, optical film 30 is preferably transparent for the light having a wavelength outside the wavelength bandwidth of the laser beam entering wavelength converting component 20.

Optical film 30 has optical properties so as to reflect part of the laser beam entering optical film 30 and transmit another part of the laser beam. In other words, optical film 30 has both of an optical property to reflect the laser beam emitted from light source 50 and an optical property to transmit the laser beam emitted from light source 50. As one example, the transmittance of optical film 30 for the light in the wavelength bandwidth of the laser beam emitted from light source 50 is 40% to 80%.

Furthermore, optical film 30 has optical properties such that the transmittance for the laser beam entering wavelength converting component 20 at the peak wavelength is 80% or less of the transmittance for the wavelength-converted light at the peak wavelength, which is radiated from wavelength converting component 20.

In the present embodiment, the laser beam emitted from light source 50 is blue light having a wavelength of 420 nm to 480 nm (peak wavelength: 450 nm), and the wavelength-converted light radiated from wavelength converting component 20 is yellow green light having a wavelength of 510 nm to 590 nm (peak wavelength: 550 nm). Thus, as its optical properties, optical film 30 has the transmission spectrum (transmittance distribution) shown in FIG. 2 as one example.

Figure 2:
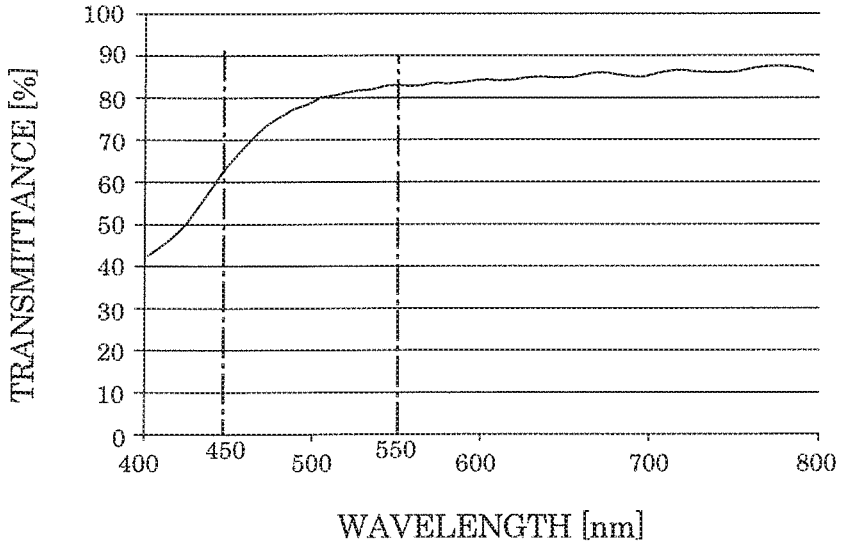
FIG. 2 is a diagram illustrating the transmission spectrum of the optical film in the illumination device according to the embodiment.

Specifically, as illustrated in FIG. 2, the transmittance of optical film 30 for the wavelength-converted light (yellow green light) in the wavelength bandwidth of 510 nm to 590 nm is 80% or more, and optical film 30 has a high transmittance for the wavelength-converted light.

As shown in FIG. 2, the transmittance of optical film 30 for the laser beam (blue light) in the wavelength bandwidth of 420 nm to 480 nm is 48% to 75% and the transmittance of optical film 30 for the laser beam at the peak wavelength (450 nm) is 63.1%. In other words, the half or more of the laser beam entering optical film 30 is transmitted and the half or less of the laser beam entering optical film 30 is reflected. Part of the laser beam entering optical film 30 is absorbed by optical film 30, generating heat.

Furthermore, in FIG. 2, the transmittance of optical film 30 at the peak wavelength (550 nm) of the wavelength-converted light is 83.1% and that at the peak wavelength (450 nm) of the laser beam is 63.1%. Thus, the proportion of the transmittance (63.1%) at the peak wavelength of the laser beam to the transmittance (83.1%) at the peak wavelength of the wavelength-converted light is 631/83.1=76.0%.

Optical film 30 having such optical properties can be made of a dielectric multi-layer film composed of several dielectric films having different refractive indices. The dielectric multi-layer film may be made of organic materials, or may be made of inorganic materials.

Optical film 30 has a shape of a film, a sheet, or a plate as one example, and can have any other shape.

As illustrated in FIG. 1, light diffusing structure 40 is disposed on the inner wall of housing 10. Specifically, light diffusing structure 40 is disposed on the inner surface of bottom portion 11 and the inner surface of side wall portion 12 of housing 10. In the present embodiment, light diffusing structure 40 is disposed across the entire inner surface of housing 10.

Light diffusing structure 40 diffusely reflects the laser beam reflected by at least optical film 30. Specifically, the laser beam reflected by optical film 30 is diffused through scattering reflection by light diffusing structure 40. Although light diffusing structure 40 is disposed to diffuse the laser beam having high directivity reflected by mainly optical film 30, it may diffusely reflect not only the light in the wavelength bandwidth of the laser beam but also the light in the entire wavelength band in the visible light region. In this case, while the reflectance of light diffusing structure 40 in the entire wavelength band in the visible light region may be 100%, the reflectance does not always need to be 100%, and may be at least 90% or more. Of the light beam which enters light diffusing structure 40, part of the light beam not reflected by light diffusing structure 40 is absorbed in light diffusing structure 40 or housing 10 to generate heat, and the heat is conducted. Light diffusing structure 40 may diffusely reflect only the laser beam reflected by optical film 30.

Figure 3:
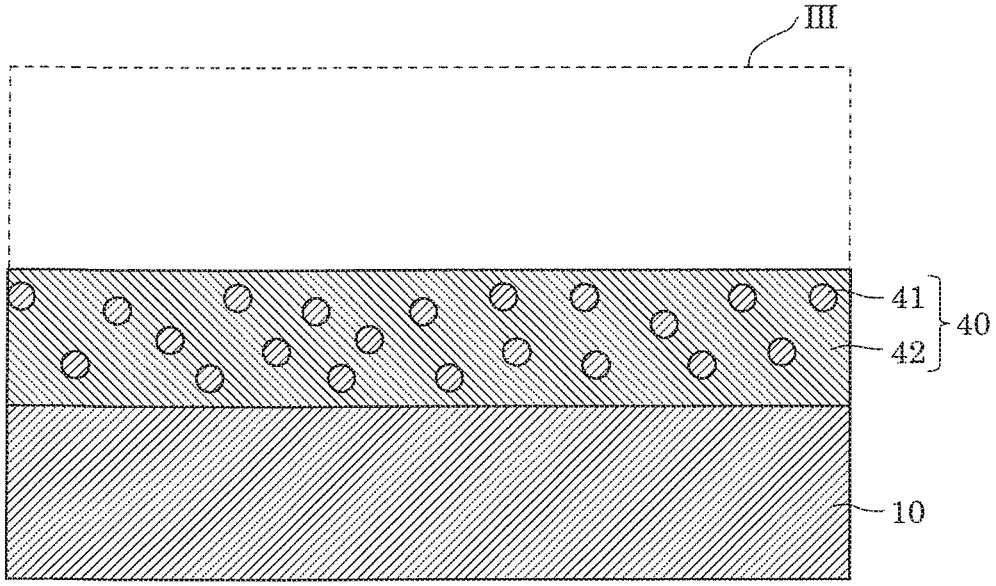
FIG. 3 is a partially enlarged cross-sectional view of region III surrounded by the dashed line in FIG. 1.

Light diffusing structure 40 to be used can be a light diffusion film including aggregates of a fine light scattering material. Here, with reference to FIG. 3, a detailed configuration of light diffusing structure 40 will be described. FIG. 3 is an enlarged cross-sectional view of region III surrounded by the dashed line in FIG. 1.

As illustrated in FIG. 3, light diffusing structure 40 is a light diffusion film including light scattering material 41 dispersed in resin 42, and is disposed on the inner wall of housing 10. Such a light diffusion film to be used can be a resin film including light diffusing nanoparticles as light scattering material 41 dispersed in a binder resin such as a polycarbonate or acrylic resin as resin 42. Specifically, a white resin film including white nanoparticles as light scattering material 41 (light diffusing nanoparticles) can be used. Such a light diffusing structure 40 can be disposed as a light diffusion coating. For example, the light diffusion coating can be disposed on the inner wall surface of housing 10 by applying a dispersion of an infinite number of light scattering material 41 dispersed in a binder resin solution onto the inner wall surface of housing 10, and curing the coating.

Figure 4:
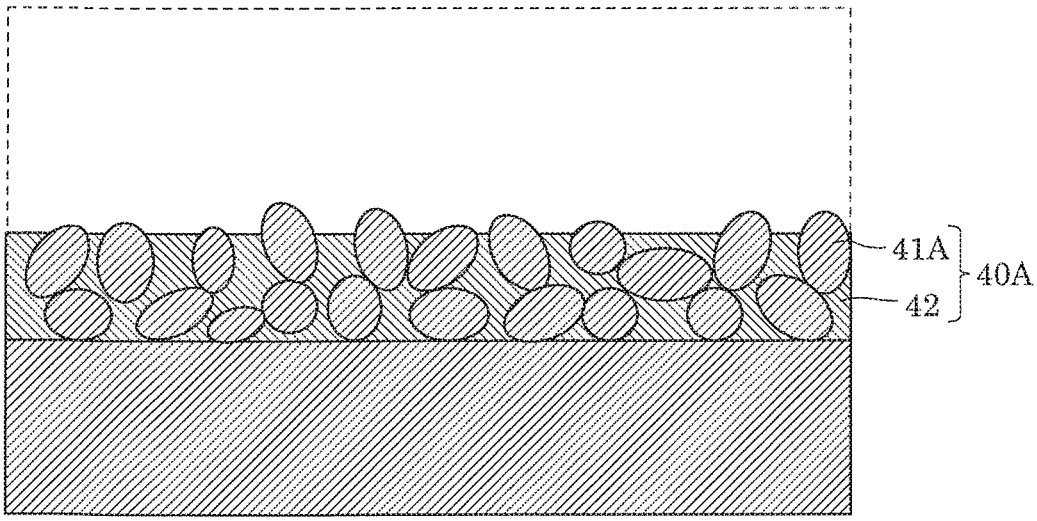
FIG. 4 is a partially enlarged cross-sectional view of the configuration of the illumination device according to Modification 1.

As light diffusing structure 40A illustrated in FIG. 4, a transparent inorganic filler may be used as light scattering material 41A, and a light diffusion film including a set of aggregates of the transparent inorganic filler may be used. In this case, as illustrated in FIG. 4, part of light scattering material 41A may be exposed from resin 42, and light scattering material 41A may not be exposed. In FIG. 3, light scattering material 41 may be exposed from resin 42.

Although light diffusing structures 40 and 40A each are separately disposed from housing 10 in the present embodiment, light diffusing structures 40 and 40A each may be integrally formed with housing 10. In this case, housing 10 is formed using the same material as those for light diffusing structures 40 and 40A.

Figure 5:
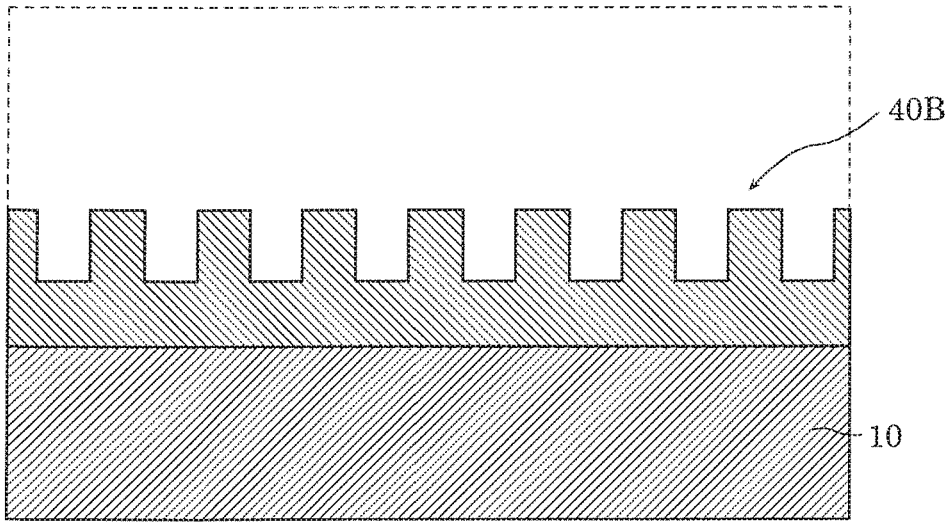
FIG. 5 is a partially enlarged cross-sectional view of the configuration of the illumination device according to Modification 2.

As illustrated in FIG. 5, light diffusing structure 40B may be a convexo-concave structure disposed on the inner wall of housing 10, rather than aggregates of light scattering material 40 or 40A. In other words, the laser beam reflected by optical film 30 may be diffusely reflected according to the shape of the convexo-concave structure. The convex-concave structure is a repetition structure of a plurality of fine projections and/or a plurality of fine depressions. In this case, the convexo-concave structure preferably contains a convexoconcave surface having a surface roughness Ra (arithmetic average roughness) of 10 μm or more. Thus, the laser beam reflected by optical film 30 can be diffusely reflected with high efficiency. The convexo-concave structure which can diffusely reflect light may be a convexo-concave film having a convexo-concave surface structure which is formed separately from housing 10 as illustrated in FIG. 5, or may be part of housing 10. In other words, a convexo-concave structure may be formed on the surface of housing 10.

Light diffusing structures 40 and 40A may be formed across the entire surface of housing 10, or may be formed on part thereof. Light diffusing structures 40 and 40A may partially include a different structure. Desired properties of illumination device 1 can be controlled according to the proportion of the area where light diffusing structure 40 or 40A is formed or the proportion of a different structure included in light diffusing structure 40 or 40A. For example, the light extraction efficiency and color temperature of the illumination light emitted from illumination device 1 can be controlled according to the proportion of the formation area.

Light diffusing structure 40 can control the reflectance of light according to its thickness and scattering intensity. The light extraction efficiency and color temperature of the illumination light emitted from illumination device 1 can be controlled by controlling the reflectance of light diffusing structure 40.

Light source 50 is a laser beam source which emits a laser beam. For example, light source 50 includes a semiconductor laser which emits a laser beam. In the present embodiment, the laser beam emitted from light source 50 is blue light. Specifically, the laser beam emitted from light source 50 is light having a peak wavelength of 450 nm and having a wavelength bandwidth of 420 nm to 480 nm, for example.

Light source 50 is disposed outside housing 10. Light source 50 is disposed such that the laser beam enters wavelength converting component 20. In the present embodiment, light source 50 is disposed such that the laser beam emitted from light source 50 enters wavelength converting component 20 with an inclination to the surface thereof.

Specifically, through hole 10*b* is disposed on side wall portion 12 of housing 10, and the laser beam is emitted from light source 50, and enters wavelength converting component 20 through hole 10*b*.

To control the orientation of the laser beam emitted from light source 50 or perform beam shaping of the laser beam, optical components such as a collimator lens and a reflective component may be disposed between light source 50 and wavelength converting component 20. Light source 50 may be disposed inside housing 10 rather than outside housing 10. In this case, through hole 10*b* of housing 10 is unnecessary.

Figure 6:
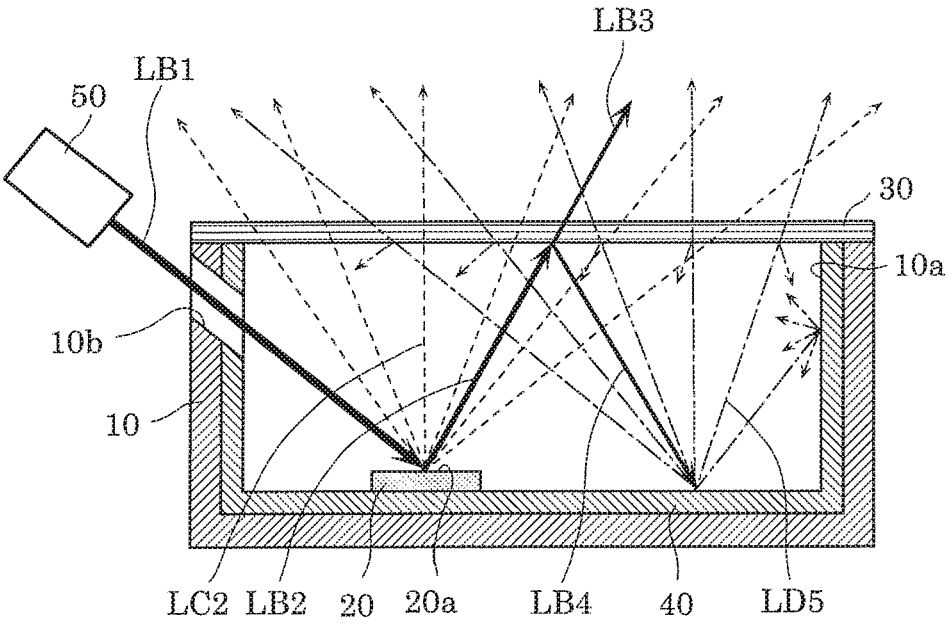
FIG. 6 is a diagram illustrating trajectories of light beams of the illumination device according to the embodiment.

Next, the optical action of illumination device 1 according to the present embodiment will be described with reference to FIG. 6. FIG. 6 is a diagram illustrating trajectories of light beams in illumination device 1 according to the embodiment.

As illustrated in FIG. 6, after laser beam LB1 is emitted from light source 50, laser beam LB1 (the solid bold line in FIG. 6) enters the surface of wavelength converting component 20 from an oblique direction. When laser beam LB1 enters wavelength converting component 20, part of laser beam LB1 is absorbed in wavelength converting component 20 to be subjected to wavelength conversion. Wavelength-converted light LC2 (the dashed line in FIG. 6) having a wavelength different from that of laser beam LB1 is radiated from wavelength converting component 20, and another part of laser beam LB1 is reflected by wavelength converting component 20 without being absorbed in wavelength converting component 20 to be converted into laser beam LB2 (the solid semi-bold line in FIG. 6).

As a result, wavelength-converted light LC2 and the reflected laser beam LB2 are radiated from wavelength converting component 20. At this time, wavelength-converted light LC2 is radiated in all the directions. Laser beam LB2 reflected by wavelength converting component 20 is radiated while maintaining directivity.

Wavelength-converted light LC2 and laser beam LB2 radiated from wavelength converting component 20 travel to optical film 30, and enter optical film 30.

At this time, optical film 30 has a transmittance of 80% or more for the wavelength-converted light generated in wavelength converting component 20. For this reason, most of wavelength-converted light LC2 which enters optical film 30 transmits through optical film 30, and is radiated to the outside of housing 10.

Optical film 30 has both an optical property to reflect the laser beam emitted from light source 50 and an optical property to transmit the laser beam emitted from light source 50. For this reason, part of laser beam LB2 which enters optical film 30 travels straight and transmits through optical film 30, and is radiated to the outside of housing 10 as laser beam LB3 (the solid thin line in an upper portion of FIG. 6), and another part of laser beam LB2 is reflected by optical film 30, and travels toward the lower portion of housing 10 as laser beam LB4 (the solid thin line in a lower portion of FIG. 6). In other words, laser beam LB2 which enters optical film 30 is separated into laser beam LB3 (light traveling straight) and laser beam LB4 (reflected light) by optical film 30.

Laser beam LB4, which is reflected by optical film 30 and travels to the lower portion of housing 10, enters light diffusing structure 40 disposed on the inner wall of housing 10. Light diffusing structure 40 has a function to diffusely reflect at least the laser beam emitted from light source 50. Thus, laser beam LB4 which enters light diffusing structure 40 is diffusely reflected by light diffusing structure 40, and is radiated from light diffusing structure 40 as diffused light LD5 (the dashed-and-dotted line in FIG. 6) in an isotropic-scattering manner.

Diffused light LD5 diffusely reflected by light diffusing structure 40 travels toward the upper portion of housing 10 inside housing 10. In other words, diffused light LD5 travels toward optical film 30, and enters optical film 30.

Here, diffused light LD5 has the same wavelength as that of the laser beam emitted from light source 50. As described above, optical film 30 has both an optical property to reflect the laser beam emitted from light source 50 and an optical property to transmit the laser beam emitted from light source 50. Accordingly, part of diffused light LD5 which enters optical film 30 travels straight and transmits through optical film 30, and is radiated to the outside of housing 10, while another part of diffused light LD5 which enters optical film 30 is reflected by optical film 30 to return to the inside of housing 10, and travels toward the lower portion of housing 10.

The diffused light of diffused light LD5, which is reflected by optical film 30 and travels inside housing 10 toward the lower portion thereof, is again diffusely reflected by light diffusing structure 40 and reenters optical film 30. In other words, diffused light LD5 is repeatedly subjected to reflection by and transmission through optical film 30 and diffuse reflection by light diffusing structure 40.

As a result, laser beam LB4, which is reflected by wavelength converting component 20 and then by optical film 30, is finally converted to diffused light by light diffusing structure 40. In other words, laser beam LB4 is completely converted to diffused light, transmits through optical film 30, and is radiated to the outside of housing 10. For this reason, irrespective of the absorptivity of wavelength converting component 20, light diffusibility for laser beam LB1 emitted from light source 50 can be ensured.

At this time, as a result of laser beam LB4 being repeatedly subjected to reflection by and transmission through optical film 30 and diffuse reflection by light diffusing structure 40, laser beam LB3 can have a sufficiently small light quantity to the light quantity extracted as the diffused light to the outside of housing 10. Thus, color unevenness of the irradiation pattern of the mixed light can be reduced.

Thus, in illumination device 1 according to the present embodiment, the laser beam having high directivity can have diffusibility because of optical film 30 and light diffusing structure 40 even if the light diffusibility is not imparted to wavelength converting component 20. The wavelength-converted light generated by wavelength converting component 20 using the laser beam as excitation light has diffusibility. In other words, the laser beam radiated from opening portion 10*a* of housing 10 and the wavelength-converted light both are diffused light, and are turned into mixed light having a desired mixed color (mixed-color light). Accordingly, color unevenness generated in the irradiation pattern of the illumination light emitted from illumination device 1 can be reduced.

Furthermore, in illumination device 1 according to the present embodiment, formation of projections and depressions on the surface of wavelength converting component 20 or mixing of a filler having light scattering properties in wavelength converting component 20 is unnecessary for the purpose of enhancing the light diffusibility of wavelength converting component 20, and therefore the absorptivity of the laser beam in wavelength converting component 20 can be maintained at high level. Thus, a narrow color range of the mixed-color light as the mixed light of the laser beam and the wavelength-converted light can be avoided, increasing the freedom of color design of the mixed light.

In addition, because illumination device 1 according to the present embodiment has a configuration in which the section having a function to diffuse the laser beam is separated from the section having a function to absorb the laser beam and perform wavelength conversion on the laser beam, only mainly the laser beam can be selectively diffused between the laser beam and the wavelength-converted light. Accordingly, a reduction in light extraction efficiency due to back scattering of the wavelength-converted light is avoided in illumination device 1, unlike the traditional illumination device including the diffusion transmission component where such back scattering is caused by diffusion of not only the laser beam but also the wavelength-converted light whose further diffusion is unnecessary.

As described above, in illumination device 1 according to the present embodiment, color unevenness of the illumination light can be reduced without reducing the light extraction efficiency, and color design of the mixed light in a wide color range is enabled.

Figure 7:
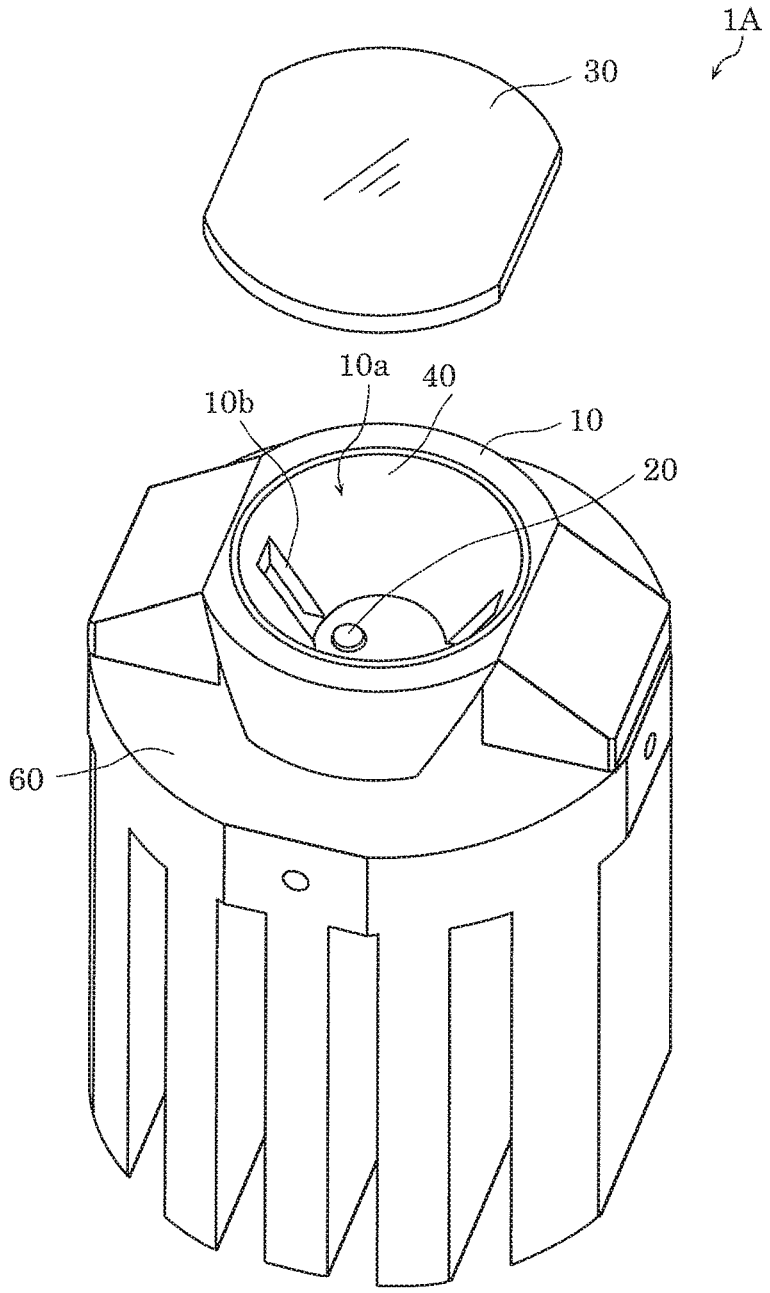
FIG. 7 is a perspective view of the illumination device according to an example of application.
Figure 8:
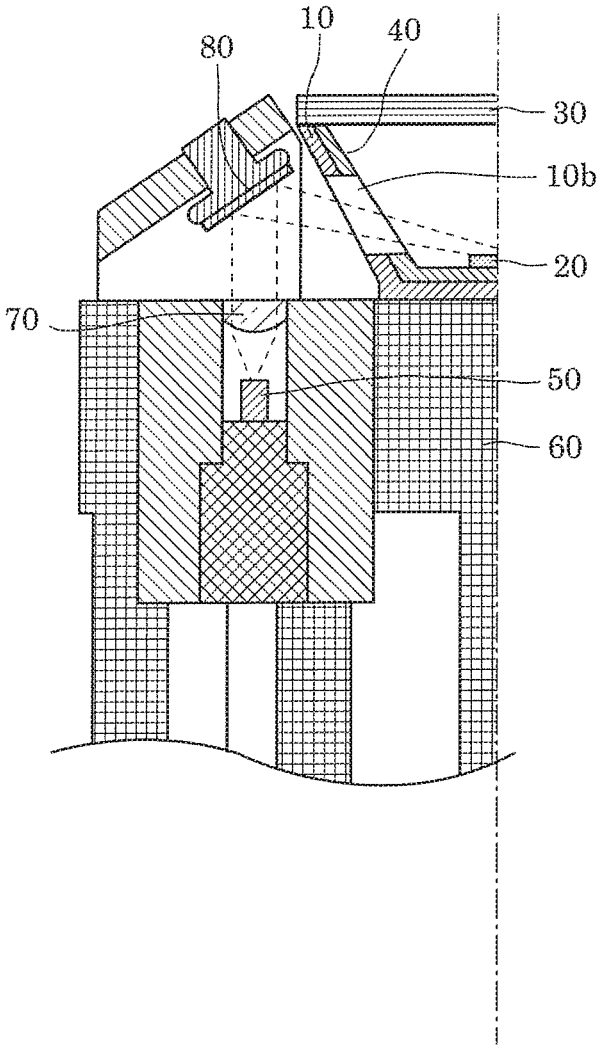
FIG. 8 is a partial cross-sectional view of the illumination device according to the example of application.

Here, an example of application of illumination device 1 according to the embodiment will be described with reference to FIGS. 7 and 8. FIG. 7 is a perspective view of illumination device 1A according to an example of application. FIG. 8 is a partial cross-sectional view of illumination device 1A. FIG. 7 illustrates a state where optical film 30 is removed.

As illustrated in FIGS. 7 and 8, illumination device 1A according to the present modification further includes base 60, lens 70, and reflective component 80.

Base 60 is the main body including housing 10 and light source 50. Housing 10 is placed on the top surface of base 60. Light source 50 is accommodated inside base 60.

Base 60 also functions as a heat sink to dissipate heat generated in wavelength converting component 20 through light source 50 and housing 10. Accordingly, base 60 is preferably made of a material having high thermal conductivity such as a metallic material (such as aluminum) or a highly heat conductive resin.

Lens 70 is a collimator lens. The laser beam radially emitted from light source 50 is converted to parallel light having a predetermined beam diameter by lens 70.

Reflective component 80 reflects the laser beam emitted from light source 50, and emits the reflected laser beam to wavelength converting component 20 disposed inside housing 10. Specifically, reflective component 80 reflects the laser beam collimated by lens 70. Reflective component 80 is attached to part of base 60.

Although light source 50 is held by base 60 in the present modification, light source 50 may be disposed outside base 60 and the laser beam may be transmitted from light source 50 through an optical fiber to cause the laser beam to enter reflective component 80. In this case, an end portion of the optical fiber is disposed at the position of light source 50 in FIG. 8.

Modifications

The illumination device according to the present disclosure has been described by way of the embodiments, but the embodiments above should not be construed as limitations to the present disclosure.

For example, in the embodiments above, illumination device 1 may be a lighting apparatus as a product, or may be used as a part (light source module) incorporated in the lighting apparatus.

Figure 9:
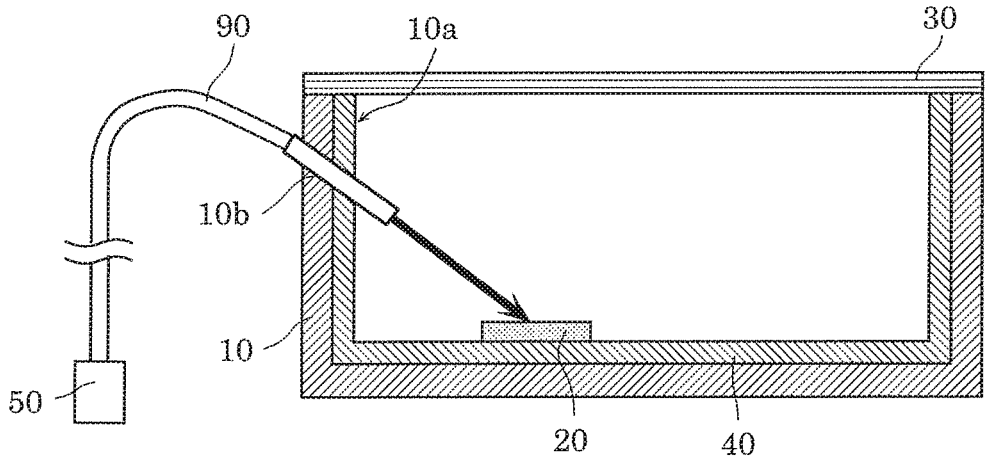
FIG. 9 is a diagram illustrating the configuration of the illumination device according to Modification 3.

Although the laser beam emitted from light source 50 is caused to enter wavelength converting component 20 in the embodiments above, irradiation of wavelength converting component 20 with the laser beam can be performed by any other method. For example, as illustrated in FIG. 9, the laser beam emitted from light source 50 may be transmitted through optical fiber 90, and the laser beam emitted from one end portion of optical fiber 90 may be emitted to wavelength converting component 20. In this case, in FIG. 9, the light emitting portion (one end portion of optical fiber 90) is disposed inside housing 10. The light emitting portion may be disposed outside housing 10.

Figure 10:
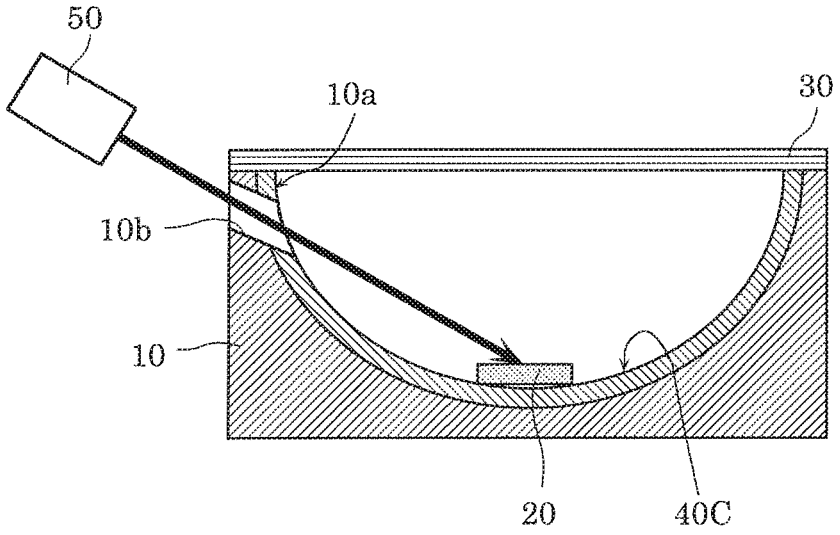
FIG. 10 is a diagram illustrating the configuration of the illumination device according to Modification 4.

Although light diffusing structure 40 including aggregates of a light scattering material (FIG. 3) or light diffusing structure 40A having a convexo-concave structure on its surface (FIG. 4) is disposed on the inner wall of housing 10 as the structure to diffuse light in the embodiments above, any other structure to diffuse light can be used. For example, as illustrated in FIG. 10, light diffusing structure 40C may have a concave surface defined by a curved surface of the inner wall (inner wall surface) of housing 10. In this case, light diffusing structure 40C may have a smooth concave surface defined by a curved inner wall surface of housing 10, or may include the aggregates of a light scattering material illustrated in FIGS. 3 and 4 or the convexo-concave structure illustrated in FIG. 5 on the surface of the concave surface.

Although the illumination device according to the embodiments above is of a reflective type which reflects the laser beam on wavelength converting component 20, the present disclosure can be used in a transmissive illumination device which transmits the laser beam through wavelength converting component 20.

Besides, the present disclosure also covers embodiments obtained from a variety of modifications of the embodiments and modifications above conceived by persons skilled in the art and those implemented with any combinations of the components and the functions in the embodiments and modifications without departing the gist of the present disclosure.

The invention claimed is:

1. An illumination device comprising: a housing including an opening portion; a wavelength converting component which is disposed inside the housing and radiates wavelength-converted light after a laser beam enters the housing and is reflected by the wavelength converting component, the wavelength-converted light having a different wavelength from a wavelength of the laser beam; an optical film which covers the opening portion, the optical film having optical properties such that a transmittance for the wavelength-converted light is 80% or more and a transmittance for the laser beam at a peak wavelength is 80% or less of a transmittance for the wavelength-converted light at a peak wavelength; and a light diffusing structure which is disposed on an inner surface of a bottom portion of the housing and an inner surface of a side wall portion of the housing and diffusely reflects a part of the laser beam that is reflected by at least the optical film of the laser beam reflected by the wavelength converting component and incident on the optical film, wherein the illuminating device is of a reflective type in which the laser beam that is incident on the wavelength converting component is reflected by the wavelength converting component without being transmitted by the wavelength converting component, the optical film is disposed opposite to the inner surface of the bottom portion of the housing, the wavelength converting component is placed on a portion of the inner surface of the bottom portion of the housing covered by the light diffusing structure, and the laser beam enters the housing via a through hole going through the light diffusing structure and the side wall portion of the housing and is obliquely incident on the wavelength converting component.

2. The illumination device according to claim 1, wherein the light diffusing structure is a convexo-concave structure disposed on the inner wall.

3. The illumination device according to claim 2, wherein the convexo-concave structure includes a convexo-concave surface having a surface roughness Ra of 10 μm or more.

4. The illumination device according to claim 1, wherein the transmittance of the optical film for the wavelength-converted light is 90% or more.

5. The illumination device according to claim 1, wherein the light diffusing structure is a light diffusion film disposed on the inner wall.

6. The illumination device according to claim 1, wherein the light diffusing structure is a set of aggregates of a transparent inorganic filler.

7. The illumination device according to claim 1, wherein the light diffusing structure is a concave surface defined by a curved surface of the inner wall.

8. The illumination device according to claim 1, further comprising:

a light source which emits the laser beam.

* * * * *